US005740779A

United States Patent [19]

Spencer-Smith

[11] Patent Number: 5,740,779

[45] Date of Patent: Apr. 21, 1998

[54] APPARATUS FOR REDUCING EVAPORATIVE HYDROCARBON FUEL EMISSIONS FROM AN INTERNAL COMBUSTION ENGINE AND FOR IMPROVING THE PERFORMANCE THEREOF

[75] Inventor: Mike Spencer-Smith, Napa, Calif.

[73] Assignee: Northern California Diagnostic Laboratories, Inc., Napa, Calif.

[21] Appl. No.: 790,207

[22] Filed: Feb. 5, 1997

Related U.S. Application Data

[63] Continuation-in-part of Ser. No. 780,849, Jan. 9, 1997, abandoned.

[51] Int. Cl.[6] ..... F02M 7/00

[52] U.S. Cl. ..... 123/394; 123/442; 261/64.3

[58] Field of Search ..... 123/198 DB, 394, 123/DIG. 11, 442; 261/64.3, 64.4, 306

[56] References Cited

U.S. PATENT DOCUMENTS 3,744,471 7/1973 Braun et al. ..... 123/198 DB 4,212,276 7/1980 Kaneda ..... 123/516

5,535,986 7/1996 Hutchens et al. ..... 251/306

OTHER PUBLICATIONS

P. 34, Harley–Davidson 1996 Parts Manual.

*Primary Examiner*—Willis R. Wolfe, Jr.
*Assistant Examiner*—Hieu T. Vo
*Attorney, Agent, or Firm*—Thomas R. Lampe

[57] ABSTRACT

A sensor is employed in conjunction with an internal combustion engine having at least one hydrocarbon fuel combustion chamber and an air inlet for introducing air into the combustion chamber to sense termination of operation of the internal combustion engine. The sensor closes a valve leading to a carburetor inlet of the engine when termination of operation of the internal combustion engine is sensed. The valve and associated structure improve the performance of the internal combustion engine when the valve is in open position by enhancing fluid flow through the air inlet leading to the carburetor during operation of the internal combustion engine.

17 Claims, 6 Drawing Sheets

APPARATUS FOR REDUCING EVAPORATIVE HYDROCARBON FUEL EMISSIONS FROM AN INTERNAL COMBUSTION ENGINE AND FOR IMPROVING THE PERFORMANCE THEREOF

This application is a continuation-in-part of U.S. patent application Ser. No. 08/780,849, filed Jan. 9, 1997, and now abandoned.

TECHNICAL FIELD

This invention relates to the field of internal combustion engines and more particularly to apparatus for reducing evaporative hydrocarbon fuel emissions from an internal combustion engine and for improving the performance thereof. The invention is applicable, for example, to motorcycles.

BACKGROUND OF THE INVENTION

Evaporative emissions from liquid hydrocarbon fuels can and do contribute to environmental degradation by polluting the atmosphere. Motor vehicles, including motorcycles, can cause particular problems in this regard, especially when carburetor systems rather than fuel injection systems are employed.

Motorcycles, particularly those incorporating carburetor systems, release hydrocarbon fuel evaporative emissions when the engine has been turned off. Such emissions escape from the gas tank, fuel lines and other components of the engine through the carburetor and vent through the air filter associated therewith into the ambient atmosphere.

A number of approaches have been employed in the motorcycle art to reduce this problem; however, such approaches have not been effective, nor have they found widespread acceptance by cyclists. Restrictive air filter elements have been employed in some instances to reduce the emissions problem. Unfortunately, such an approach usually degrades the performance of the motorcycle during use. Restrictive structure also has been established between the motorcycle carburetor and the air filter element with the same unsatisfactory results. The undesired consequence has been that such devices have been modified or removed from motorcycles altogether, after sale of a cycle, so that there is no reduction of evaporative emissions at all. The motorcycles then are not in compliance with the laws of California and possibly other jurisdictions designed to protect the environment.

The Harley-Davidson 1996 Parts Manual discloses on page 34 thereof a mechanism employed with carbureted motorcycle models in an attempt to reduce hydrocarbon evaporative emissions wherein a solenoid operated flap is located in an assembly comprising part of the air filter housing. The flap is opened when the cycle engine operates to allow air to flow through a housing passageway and is closed when the cycle engine does not operate. The flap system does not provide an effective seal when closed, is not directly connected to or directly associated with the carburetor, and has no positive performance effects. The flap is part of an overall system which requires a restrictive air filter to provide a significant degree of evaporative emission control.

DISCLOSURE OF INVENTION

The present invention relates to apparatus which efficiently and effectively reduces evaporative hydrocarbon fuel emissions from internal combustion engines, particularly motorcycle engines, when the engines are not in operation. When an engine is placed in operation, the apparatus of the present invention not only does not adversely affect the performance thereof, but it actually improves engine performance as compared to an engine identical in all respects except for employing structure incorporating the teachings of the present invention. In other words, a cyclist or other individual interested in engine performance will have the best of both worlds-improved engine performance and evaporative emissions control.

The invention relates to a structural combination including an internal combustion engine having at least one hydrocarbon fuel combustion chamber and including air inlet defining means defining an air inlet for introducing air into the at least one hydrocarbon fuel combustion chamber.

Sensing means is provided for sensing termination of operation of the internal combustion engine.

Fluid flow modifying means is operatively associated with the sensing means and with the internal combustion engine for reducing evaporative hydrocarbon fuel emissions from the internal combustion engine through the air inlet into the ambient atmosphere when the sensing means senses termination of operation of the internal combustion engine and also for improving the performance of the internal combustion engine by enhancing fluid flow through the air inlet during operation of the internal combustion engine.

The fluid flow modifying means comprises a valve member movable relative to the internal combustion engine between a closed position wherein the valve member substantially prevents fluid flow through the air inlet and an open position wherein fluid flow through the air inlet is generally unrestricted by the valve member.

In the preferred embodiment disclosed herein, the air inlet defining means comprises a carburetor. The valve member is movably mounted relative to the carburetor and substantially prevents exit of evaporative hydrocarbon fuel emissions from the internal combustion engine through the carburetor into the ambient atmosphere when the valve member is in closed position. However, when in open position, the valve member and other structural components of the apparatus cooperate to improve engine performance.

Other features, advantages, and objects of the present invention will become apparent with reference to the following description and accompanying drawings.

MODES FOR CARRYING OUT THE INVENTION

Figure 1:
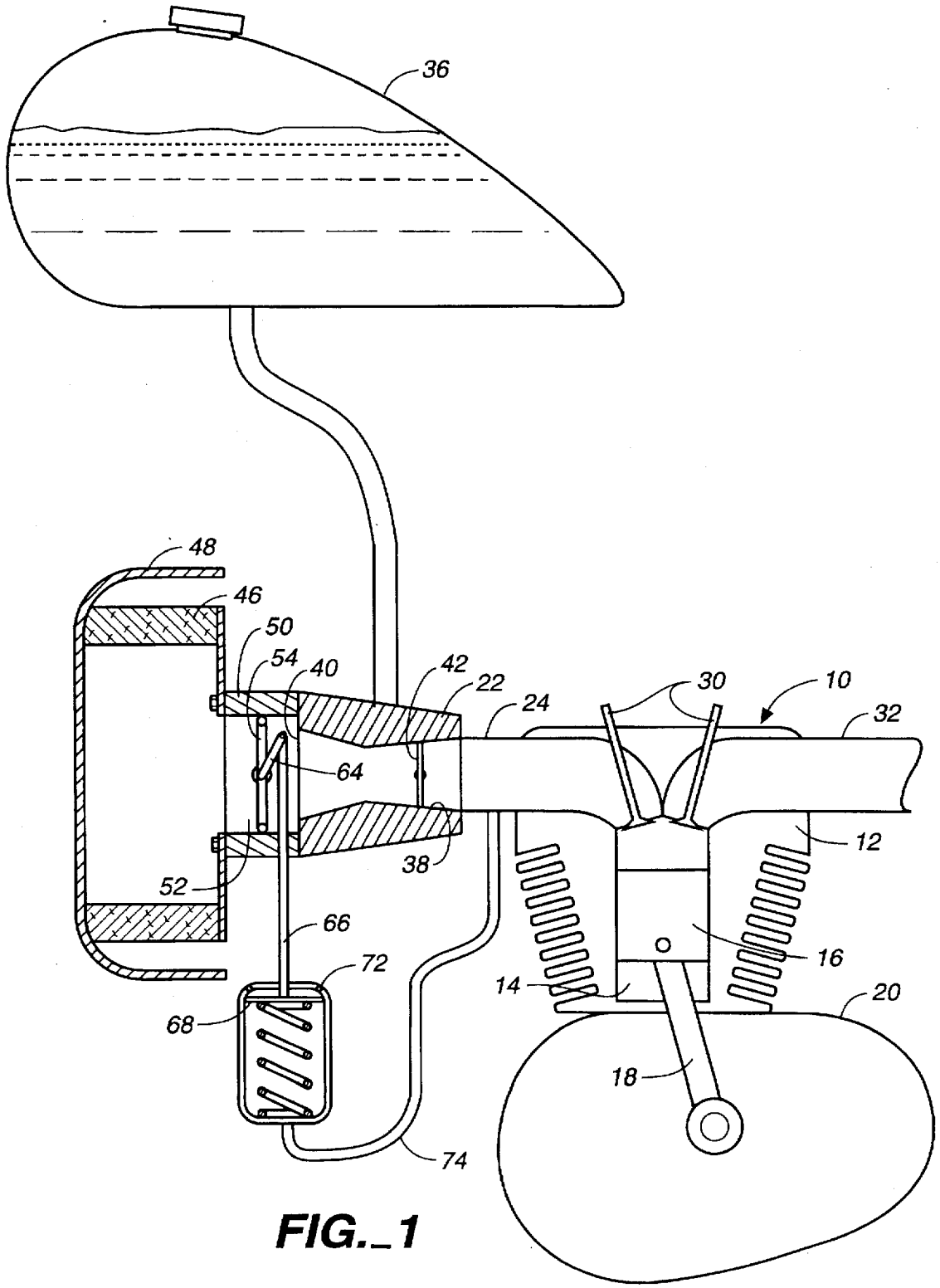
FIG. 1 is a partially cross-sectional, schematic side view of apparatus constructed in accordance with the teachings of the present invention and illustrating a butterfly valve and related structure in the positions assumed thereby when the butterfly valve is preventing exit of evaporative hydrocarbon fuel emissions from a motorcycle engine.

Referring now to FIGS. 1–6 of the drawings, a conventional motorcycle engine is generally designated by reference numeral 10. Engine 10 includes a cylinder body 12 defining a hydrocarbon fuel combustion chamber 14. A piston 16 reciprocates within the combustion chamber in the well known manner, the piston 16 having a piston rod 18 extending therefrom into crank case 20.

The motorcycle engine also includes a carburetor 22 for delivering a mixture of air and gasoline to combustion chamber 14 through an intake manifold 24 or other suitable air intake means.

As is conventional, valves 30 are operatively associated with the cylinder body. Exhaust from the combustion chamber exits from exhaust pipe 32.

As is conventional, carburetor 22 receives fuel from a fuel tank 36. The liquid hydrocarbon fuel, conventionally gasoline, mixes with air in the carburetor interior 38, the air entering the carburetor interior through carburetor air inlet opening 40. Carburetor valve 42, conventionally a butterfly valve, controls flow of the air/fuel mixture from the carburetor into the combustion chamber.

Air entering carburetor 22 first passes through an air filter 46 covered by an air filter cover 48.

As indicated above, motorcycles, particularly those incorporating carburetor systems, release hydrocarbon fuel evaporative emissions when the engine has been turned off. Such emissions escape from the gas tank, fuel lines and other components of the engine through the air intake opening of the carburetor and vent through the air filter associated therewith into the ambient atmosphere.

With the arrangement of the present invention, evaporative hydrocarbon fuel emissions are blocked and prevented from escaping the closed engine system to the air filter. Thus, no restrictive air filter elements or other restrictive structures in the air inlet passageway need be employed to prevent escape of the evaporative hydrocarbon fuel emissions to the ambient atmosphere. A conventional air filter can be utilized and performance of the motorcycle engine will not be adversely affected. In fact, as will be seen below, performance is actually enhanced through adoption of this invention.

In the embodiment of the present invention disclosed in FIGS. 1–6, a mounting member 50 is attached to the carburetor 22 by mechanical fasteners or other suitable expedients. The mounting member 50 has a mounting member opening 52 in communication with the carburetor air inlet opening 40. The mounting member opening has a circular cross-section. Rotatably mounted within the mounting member 52 is a valve member in the form of a butterfly valve 54.

Figure 2:
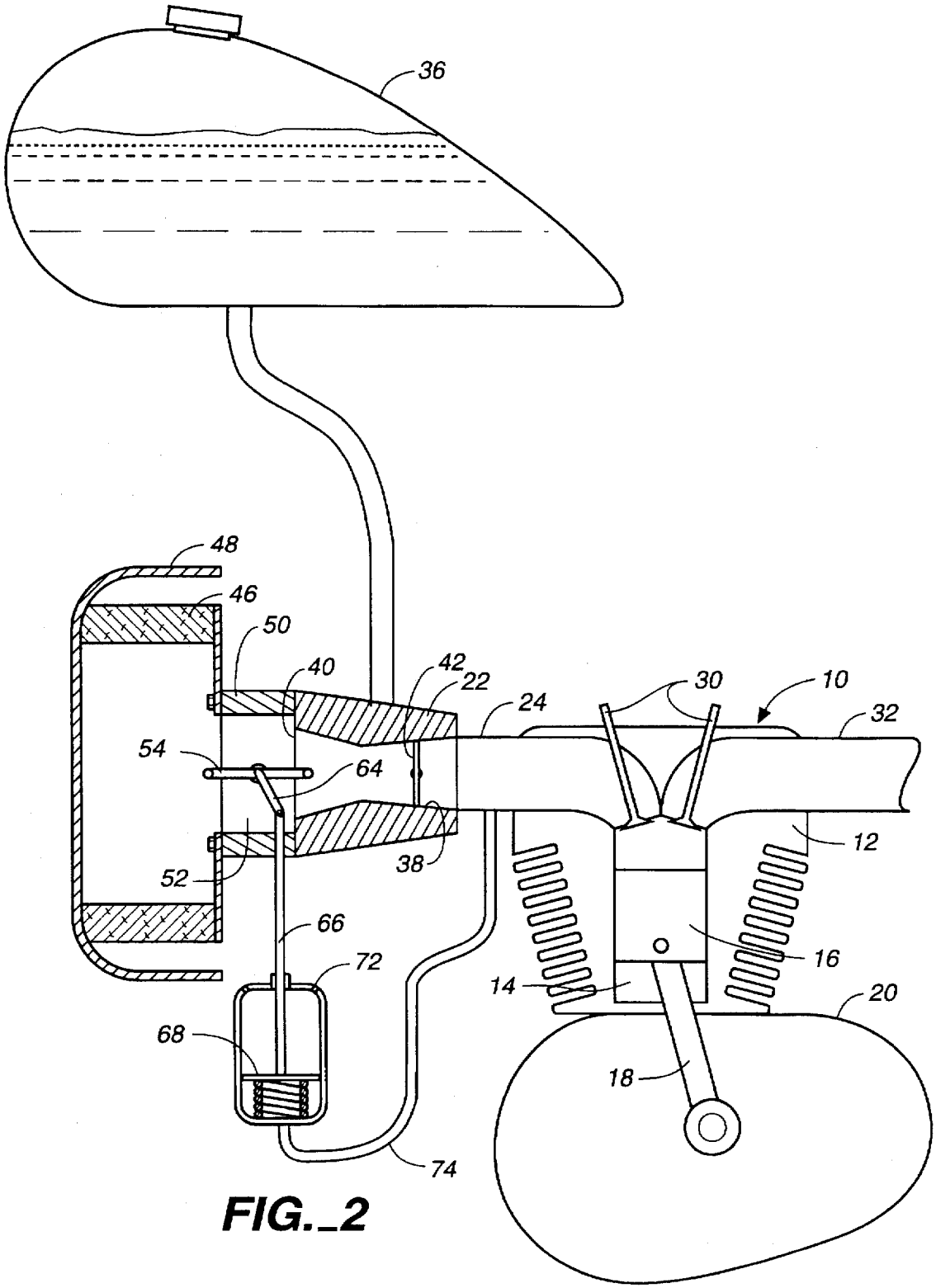
FIG. 2 is a view similar to FIG. 1 but illustrating the butterfly valve in open condition to allow the flow of air into the carburetor of the motorcycle engine.
Figure 4:
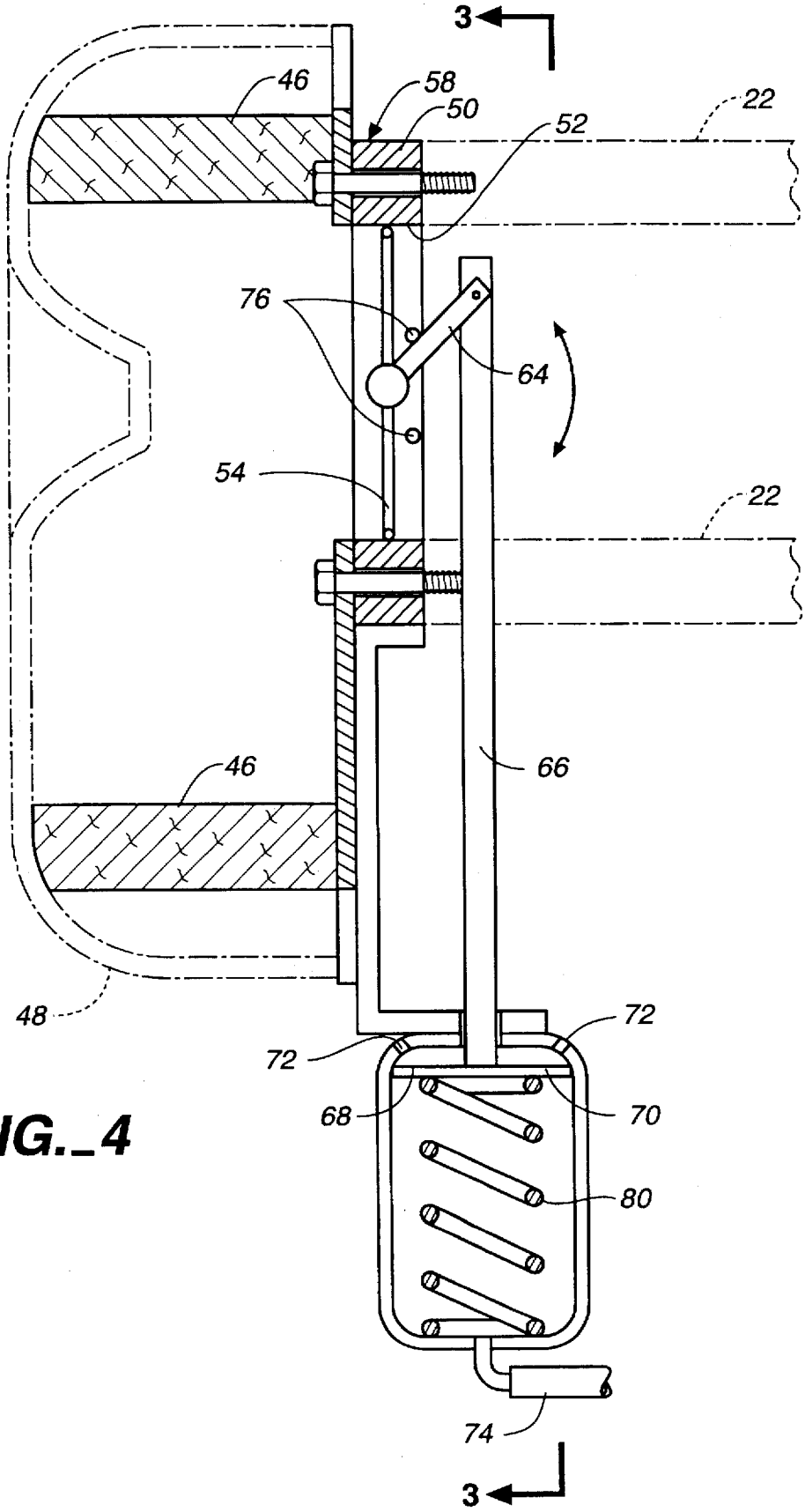
FIG. 4 is a side sectional view taken along the line 4—4 and illustrating selected structural components of the apparatus, including the butterfly valve thereof, in the positions assumed thereby when evaporative hydrocarbon fuel emissions are being blocked by the butterfly valve.
Figure 5:
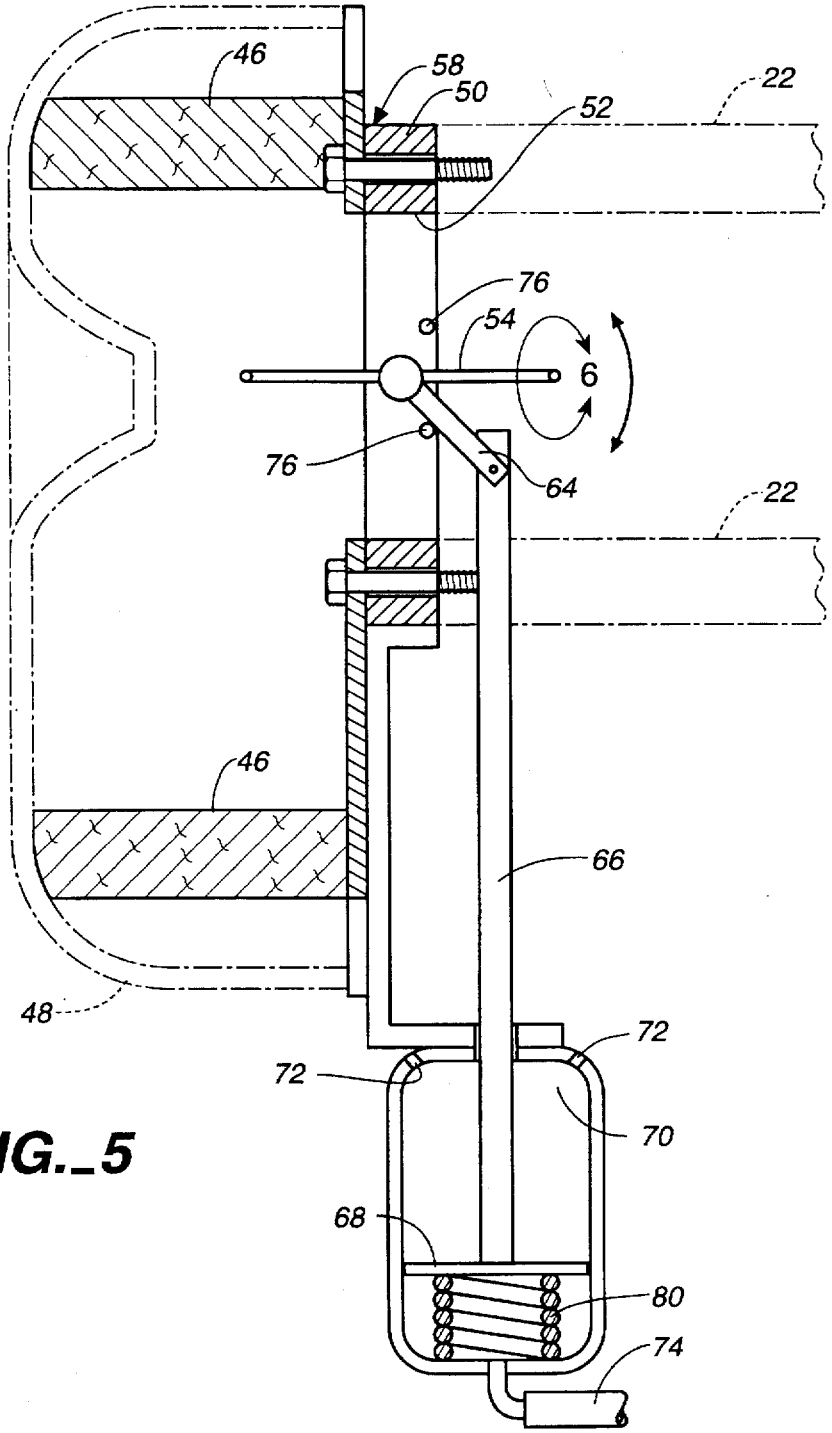
FIG. 5 is a view similar to FIG. 4 but illustrating the butterfly valve in open condition.

Butterfly valve 54 is movable between a closed position (shown in FIGS. 1 and 4, for example) and an open position shown in FIGS. 2 and 5. When in the closed position, the butterfly valve 54 forms a seal at the periphery thereof with the interior of the mounting member. Such seal substantially prevents fluid flow through the carburetor air inlet opening 40. That is, when the butterfly valve is in closed position and a fluid-tight seal is formed between the butterfly valve and the mounting member, exit of evaporative hydrocarbon fuel emissions from the internal combustion engine through the carburetor into the ambient atmosphere will be prevented.

On the other hand, when the butterfly valve is in its open position, fluid flow through the carburetor air inlet opening is essentially unrestricted by the valve member. It will be appreciated that the engine will not operate when the butterfly valve 54 is in closed position.

The embodiment of the invention illustrated in FIGS. 1–6 includes sensing means for sensing termination of operation of the internal combustion engine, and the butterfly valve will only move to its closed position upon the sensed termination of operation. When, however, the rider operates the engine by starting same, the butterfly valve 54 will move to its open position. These butterfly valve movements are accomplished automatically with the illustrated arrangement.

Butterfly valve 54 includes a butterfly valve body having a circular-shaped outer peripheral edge. A seal 60, which will be described in greater detail below, extends about the outer peripheral edge. Butterfly valve body 58 is fastened to a support shaft 62 rotatably mounted on the mounting member 50.

Extending from one end of support shaft 62 is a linkage arm 64 secured fixedly to the rotatable support shaft. Connected to the distal end of linkage arm 64 is another linkage arm 66, the arms being pivotedly connected together. It will be appreciated that up or down movement of linkage arm 66 will rotate the butterfly valve body 58.

The lower end of linkage arm 66 is affixed to a movable plate-like divider element 68 positioned in the interior of a housing 70 and dividing the housing 70 into two housing interior portions. The divider element 68 is free to move within housing 70 but forms a fluid-tight seal therewith.

The housing interior portion above divider element 68 is in communication with the ambient atmosphere through one or more openings 72 formed in the housing. The housing interior portion below divider element 68 (as oriented in the drawings) is in fluid flow communication with the air intake 24 through a hose or conduit 74.

Figure 3:
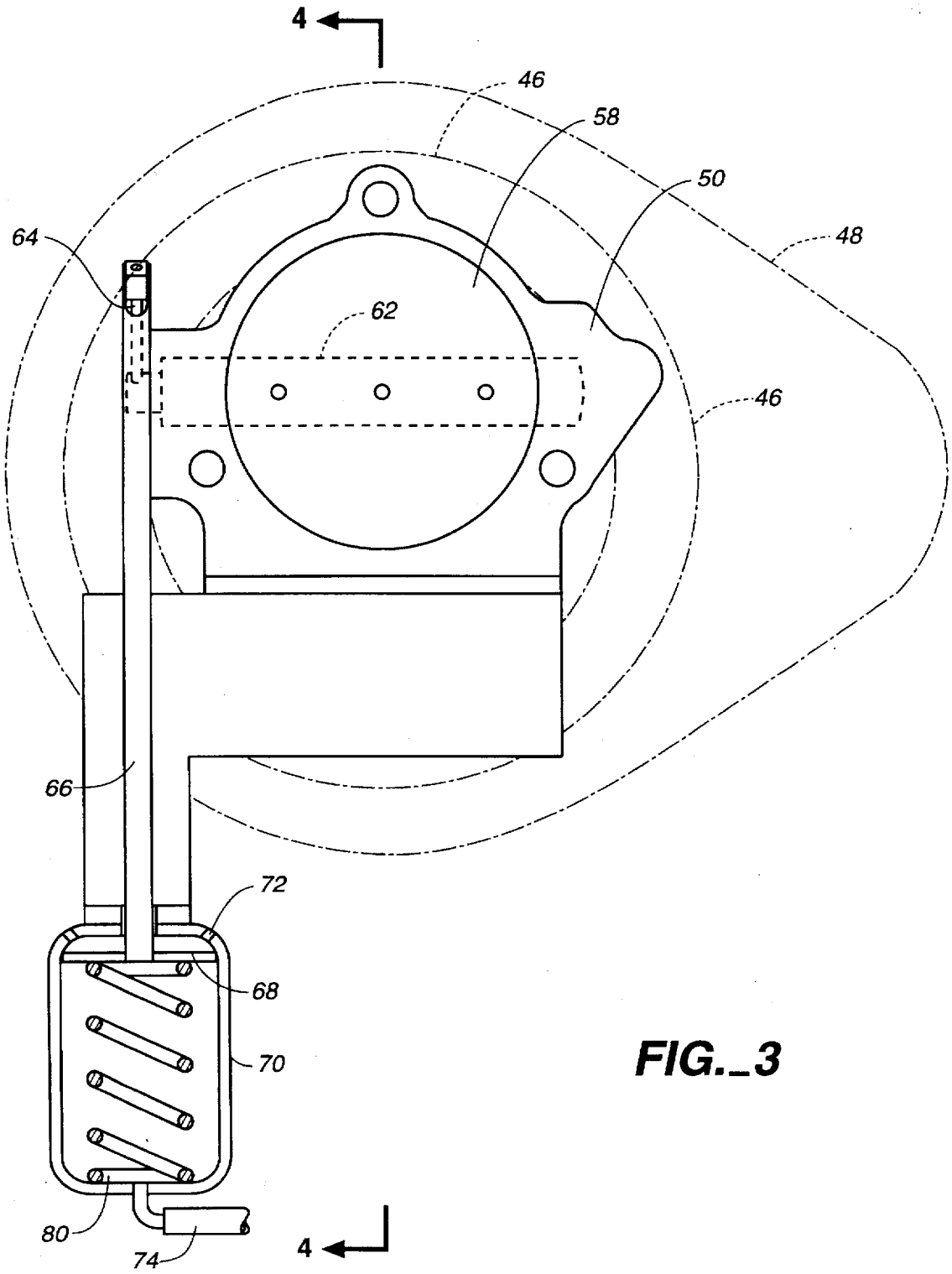
FIG. 3 is an enlarged rear elevational view taken in the direction of line 3—3 in FIG. 4 and illustrating selected details of the apparatus.

When the divider element 68 is disposed at the upper end of the housing 70 (as shown in FIGS. 1, 3 and 4, for example), the butterfly valve 54 is in its closed position to block evaporative emissions as described above. When the divider element 68 is located near the bottom of the housing 70, as shown in FIGS. 2 and 5, for example, the butterfly valve 54 is open. In the arrangement under discussion (see FIGS. 4 and 5), stop pins 76 are engageable by the linkage arm 64 to ensure proper placement of the butterfly valve in either open or closed position.

A coil compression spring is disposed between divider element 68 and the bottom of housing 70, the spring being illustrated diagrammatically and designated by reference numeral 80. The spring continuously urges the divider element 68 toward the top of the housing 70. That is, the spring 80 continuously biases the butterfly valve to closed position.

The butterfly valve will move to open position when the cyclist operates the engine by starting it. A vacuum is created at the air intake 24 as the engine turns over during the starting procedure and such vacuum is applied to the interior of housing 70 through conduit 74. When the vacuum reaches a certain level of magnitude the divider element 68 will be pulled downwardly along with linkage arms 64, 66. This will open the butterfly valve and allow the engine to actually run.

When the engine is turned off the vacuum will not be applied to the underside of the divider element and the butterfly 54 will be returned to closed position.

Figure 6:
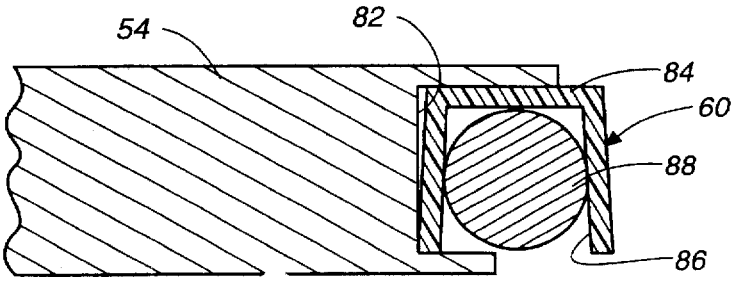
FIG. 6 is a greatly enlarged, cross-sectional, partial view taken along the line 6—6 in FIG. 5 and illustrating details of a seal employed in the butterfly valve.

The seal 60, as shown in FIG. 6, is located in a notch 82 extending circumferentially with respect to the butterfly valve body, that is along the circumference of the outer peripheral edge of the butterfly valve body. The seal is of multi-component construction and includes a seal ring 84 defining a circular recess 86 and a resilient retention member 88 in the circular-shaped recess for retaining the seal ring on the butterfly valve body. The member 88 may, for example, be an elastic band or coil spring. Any suitable seal material may be utilized to construct the seal ring, an example being tetrafluoroethylene.

As indicated above, the apparatus of the present invention not only serves in the capacity of reducing evaporative hydrocarbon fuel emissions but also improves the performance of the internal combustion engine with which it is associated by enhancing fluid flow through the air inlet leading into the combustion chamber during operation of the internal combustion engine.

Figure 7:
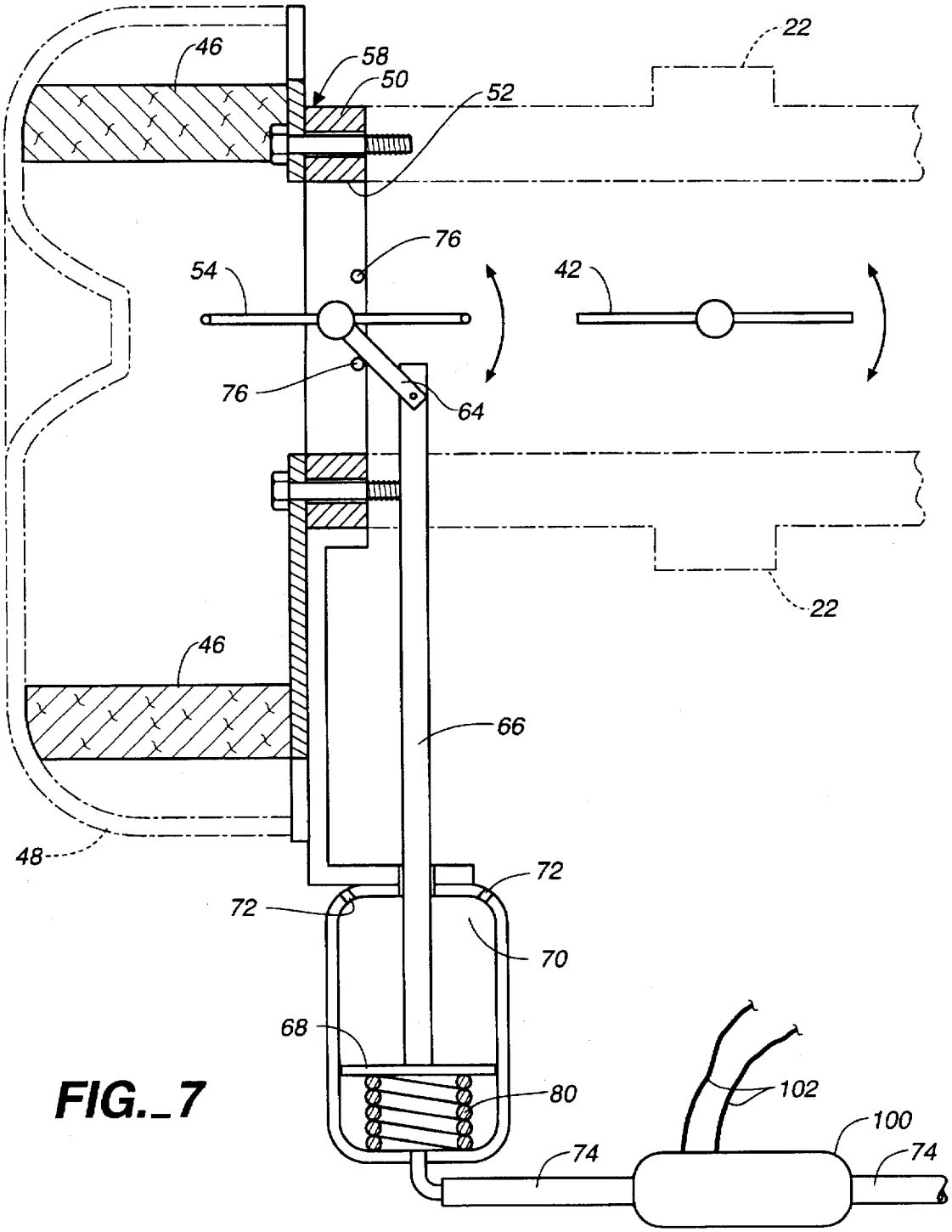
FIG. 7 is a view similar to FIG. 5 but illustrating additional structural and operational features.

FIG. 7 should be referred to in connection with the following text.

FIG. 7 illustrates the carburetor 22 in phantom and depicts in somewhat schematic fashion the carburetor valve 42 which is in the form of a butterfly valve controlling flow of air/fuel mixture from the carburetor into the combustion chamber of the associated engine. It will be appreciated that the butterfly valve 42 is movable between an open position wherein it is substantially planar to the flow of air/fuel mixture (the position shown in FIG. 7) and a closed or substantially closed position (not shown).

It will be noted that carburetor valve 42 when open is substantially co-planar with the butterfly valve 54 mounted within the interior or opening 52 of the mounting member 50 when the butterfly valve 54 is in its open position. This relationship will cause a laminar flow to exist with respect to the air/fuel mixture flowing through the carburetor. Turbulence in the air/fuel flow is reduced to increase the overall efficiency of the carburetor and hence improve engine performance.

Also contributing to the improved performance imparted to the engine by the apparatus is the fact that the mounting member opening or interior 52 of the mounting member 50 adds volume at the carburetor inlet. In effect, this structure is a velocity stack giving an increased velocity effect to the air entering the carburetor inlet. This provides an increase in horsepower and torque for a given throttle setting. Velocity stacks of a conventional nature tend to create turbulence and any turbulence resulting from use of the structure of this application will tend to be smoothed out through the cooperative relationship existing between butterfly valve 54 and throttle valve 42.

It is important to note also that the present arrangement can be utilized with any conventional type of air filter and need not be utilized with a restrictive air filter to attain the desired results. Use of a restrictive air filter, of course, would be antithetical to the object of providing increased air flow into the carburetor to enhance engine performance.

In the arrangement shown in FIG. 7, an electrically operated solenoid actuated check valve 100 is positioned in conduit 74 which provides fluid flow communication between air intake 24 (see FIG. 1) and the housing interior portion below divider element 68 in housing 70. Solenoid actuated check valve 100 is connected by wires 102 to the electrical system of the engine. When the engine key is on, air and/or hydrocarbon vapors travel one way only, towards the manifold vacuum source. When, however, the key is turned off to de-energize the ignition system, air and/or hydrocarbon vapors are free to travel both ways through valve 100.

The arrangement just described will ensure that the butterfly valve 54 will stay in open position as long as the electrical system is energized and energizes valve 100. This is to ensure that a temporary loss in manifold vacuum during operation of the motorcycle (as for example may possibly be caused during sudden acceleration) will not temporarily move the butterfly valve to its closed position.

I claim:

1. In combination:

an internal combustion engine having at least one hydrocarbon fuel combustion chamber and including air inlet defining means defining an air inlet for introducing air into the at least one hydrocarbon fuel combustion chamber and an ignition system;

sensing means for sensing termination of operation of said internal combustion engine; and fluid flow modifying means operatively associated with the sensing means and with the internal combustion engine for reducing evaporative hydrocarbon fuel emissions from said internal combustion engine through said air inlet into the ambient atmosphere when said sensing means senses termination of operation of said internal combustion engine, said fluid flow modifying means including a valve member movable relative to said internal combustion engine between a closed position wherein said valve member substantially prevents fluid flow through said air inlet and an open position wherein fluid flow through said air inlet is generally unrestricted by said valve member, said internal combustion engine additionally including air intake means having a vacuum therein during operation of said internal combustion engine and said fluid flow modifying means additionally comprising valve member mover means for moving said valve member between said open and closed positions, said sensing means sensing whether or not a vacuum exists at the air intake means, and said valve member mover means responsive to said sensing means sensing a vacuum of determinable magnitude at said air intake means to move said valve member to said open position and responsive to said sensing means not sensing a vacuum of determinable magnitude at said air intake means to move said valve member to closed position, and solenoid valve means operatively associated with said ignition system and said valve member moving means for preventing said valve member moving means from moving said valve member from said open position to said closed position while said ignition system is energized.

2. The combination according to claim 1 wherein said air inlet defining means comprises a carburetor, said valve member being movably mounted relative to said carburetor and substantially preventing exit of evaporative hydrocarbon fuel emissions from said internal combustion engine through said carburetor into the ambient atmosphere when said valve member is in closed position.

3. The combination according to claim 2 wherein said valve member comprises a butterfly valve.

4. The combination according to claim 3 wherein said butterfly valve includes a butterfly valve body having an outer peripheral edge and seal means extending about said outer peripheral edge.

5. The combination according to claim 4 wherein said inlet defining means comprises a carburetor having a carburetor air inlet, said combination additionally comprising a mounting member attached to said carburetor, said mounting member having a mounting member interior in communication with said carburetor air inlet providing a velocity stack effect, and said butterfly valve being supported by said mounting member and movable relative to said mounting member to selectively establish fluid flow communication between said mounting member interior and said carburetor air inlet or terminate communication between said mounting member interior and said carburetor air inlet.

6. The combination according to claim 4 wherein said seal means includes a seal ring, said butterfly valve body defining a notch extending along the circumference of said outer peripheral edge accommodating said seal ring.

7. The combination according to claim 6 wherein said seal ring defines a circular recess, said seal means further including a circular-shaped resilient retention member in said circular shaped recess for retaining said seal ring on said butterfly valve body.

8. The combination according to claim 3 additionally comprising stop means operatively associated with said butterfly valve for limiting movement of said butterfly valve.

9. The combination according to claim 1 wherein said sensing means comprises a housing defining an interior and movable divider means within said interior dividing said interior into a first housing interior portion in fluid flow communication with said air intake means and a second housing interior portion in communication with the ambient atmosphere, said valve member mover means comprising at least one link member interconnecting said valve member and said movable divider means, movement of said movable divider means in said housing interior causing movement of said at least one link member and said valve member.

10. The combination according to claim 9 wherein said sensing means additionally comprises biasing means continuously biasing said movable divider means toward a position within the housing interior wherein said link member positions said valve member in closed position, creation of a vacuum of determinable magnitude within said first housing interior portion overcoming the bias of said biasing means and moving said movable divider means toward a position within said housing interior wherein said at least one link member positions said valve member in open position.

11. The combination according to claim 1 wherein said internal combustion engine is a motorcycle engine.

12. The combination according to claim 1 wherein said air inlet defining means comprises a carburetor having a substantially planar throttle valve, said valve member comprising a substantially planar butterfly valve movably mounted relative to said carburetor and substantially preventing exit of evaporative hydrocarbon fuel emissions from said internal combustion engine through said carburetor into the ambient atmosphere when said butterfly valve is in closed position, said butterfly valve when in open position being substantially coplanar with said throttle valve to promote laminar fluid flow into said carburetor when said throttle valve is fully open.

13. In combination:

an internal combustion engine having at least one hydrocarbon fuel combustion chamber and including a carburetor having a substantially planar throttle valve and defining an air inlet for introducing air into the at least one hydrocarbon fuel combustion chamber; and fluid flow modifying means operatively associated with the internal combustion engine for reducing evaporative hydrocarbon fuel emissions from said internal combustion engine through said air inlet into the ambient atmosphere when operation of said internal combustion engine has been terminated and for improving the performance of said internal combustion engine by enhancing fluid flow through said air inlet during operation of said internal combustion engine, said fluid flow modifying means comprising a substantially planar butterfly valve external of said carburetor movable relative to said carburetor between a closed position wherein said butterfly valve substantially prevents fluid flow through said air inlet and an open position wherein fluid flow through said air inlet is essentially unrestricted by said butterfly valve, said butterfly valve and said throttle valve being substantially coplanar to promote laminar fluid flow into said carburetor through said air inlet when said butterfly valve is in open position and said throttle valve is fully open.

14. The combination according to claim 13 wherein said fluid flow modifying means additionally comprises a mounting member attached to said carburetor, said mounting member having a mounting member interior and a mounting opening in communication with said carburetor air inlet, and said butterfly valve being supported by said mounting member and movable relative to said mounting member to selectively open said mounting member opening to establish fluid flow communication between said mounting member interior and said carburetor air inlet or close said mounting member opening to terminate communication between said mounting member interior and said carburetor air inlet.

15. In combination:

an internal combustion engine having at least one hydrocarbon fuel combustion chamber and including a carburetor having a substantially planar throttle valve movable to an open position and defining an air inlet for introducing air into the at least one hydrocarbon fuel combustion chamber; and fluid flow modifying means operatively associated with the internal combustion engine for improving the performance of said internal combustion engine by enhancing fluid flow through said air inlet during operation of said internal combustion engine, said fluid flow modifying means comprising a substantially planar fluid flow modifying member external of said carburetor and positioned adjacent to said air inlet substantially coplanar with said throttle valve when said throttle is in said open position to promote laminar fluid flow into said carburetor through said air inlet when said throttle valve is in said open position.

16. In combination:

an internal combustion engine having at least one hydrocarbon fuel combustion chamber and including air inlet defining means defining an air inlet for introducing air into the at least one hydrocarbon fuel combustion chamber;

sensing means for sensing termination of operation of said internal combustion engine; and fluid flow modifying means operatively associated with the sensing means and with the internal combustion engine for reducing evaporative hydrocarbon fuel emissions from said internal combustion engine through said air inlet into the ambient atmosphere when said sensing means senses termination of operation of said internal combustion engine, said fluid flow modifying means including a valve member movable relative to said internal combustion engine between a closed position wherein said valve member substantially prevents fluid flow through said air inlet and an open position wherein fluid flow through said air inlet is generally unrestricted by said valve member, said internal combustion engine including air intake means having a vacuum therein during operation of said internal combustion engine and said fluid flow modifying means additionally comprising valve member mover means for moving said valve member between said open and closed positions, said sensing means sensing whether or not a vacuum exists at the air intake means, and said valve member mover means responsive to said sensing means sensing a vacuum of determinable magnitude at said air intake means to move said valve member to said open position and responsive to said sensing means not sensing a vacuum of determinable magnitude at said air intake means to move said valve member to closed position, said internal combustion engine including an ignition system and said combination additionally comprising means operatively associated with said ignition system and said valve member mover means for preventing said valve member mover means from moving said valve member from open position to closed position while said ignition system is energized, said sensing means comprising a housing defining an interior and movable divider means within said interior dividing said interior into a first housing interior portion in fluid flow communication with said air intake means and a second housing interior portion in communication with the ambient atmosphere, said valve member mover means comprising at least one link member interconnecting said valve member and said movable divider means, movement of said movable divider means in said housing interior causing movement of said at least one link member and said valve member, said means for preventing said valve member moving means from moving said valve member from open position to closed position while said ignition system is energized comprising a solenoid actuated check valve for selectively terminating fluid flow communication between said first housing interior portion and said air intake means.

17. In combination:

an internal combustion engine having at least one hydrocarbon fuel combustion chamber and including air inlet defining means defining an air inlet for introducing air into the at least one hydrocarbon fuel combustion chamber;

sensing means for sensing termination of operation of said internal combustion engine; and evaporative hydrocarbon fuel emission reduction means operatively associated with the sensing means and with the internal combustion engine for reducing evaporative hydrocarbon fuel emissions from said internal combustion engine through said air inlet into the ambient atmosphere when said sensing means senses termination of operation of said internal combustion engine, said evaporative hydrocarbon fuel emission reduction means comprising a butterfly valve movable relative to said internal combustion engine between a closed position wherein said butterfly valve member substantially prevents fluid flow through said air inlet and an open position wherein fluid flow through said air inlet is essentially unrestricted by said butterfly valve member, said butterfly valve member including a butterfly valve body having an outer peripheral edge and seal means extending about said outer peripheral edge, said seal means including a seal ring, said butterfly valve body defining a notch extending along the circumference of said outer peripheral edge accommodating said seal ring, said seal ring defining a circular-shaped recess, and said seal means further including a circular-shaped resilient retention member in said circular-shaped recess for retaining said seal ring on said butterfly valve body in said notch.

* * * * *